US005121717A

United States Patent [19]

Simko et al.

[11] Patent Number: 5,121,717

[45] Date of Patent: Jun. 16, 1992

[54] INTERNAL COMBUSTION ENGINE CAMSHAFT PHASE SHIFT CONTROL SYSTEM

[75] Inventors: Aladar O. Simko, Dearborn Heights; Michael M. Schechter, Farmington Hills, both of Mich.

[73] Assignee: Ford Motor Company, Dearborn, Mich.

[21] Appl. No.: 620,517

[22] Filed: Nov. 28, 1990

[51] Int. Cl.[5] ..... F01L 1/34

[52] U.S. Cl. ..... 123/90.17; 123/90.31

[58] Field of Search ..... 123/90.12, 90.15, 90.17, 123/90.31; 464/2

[56] References Cited

U.S. PATENT DOCUMENTS

| | | | |
|---|---|---|---|
| 2,682,260 | 6/1954 | Lantz | 123/90 |
| 2,861,557 | 11/1958 | Stolte | 123/90 |
| 3,685,499 | 8/1972 | Meacham et al. | 123/90.15 |
| 3,721,220 | 3/1973 | Garcea | 123/90.15 |
| 3,945,355 | 3/1976 | Calviac | 123/90.18 |
| 4,231,330 | 11/1980 | Garcea | 123/90.15 |
| 4,421,074 | 12/1983 | Garcea et al. | 123/90.15 |
| 4,535,731 | 8/1985 | Banfi | 123/90.15 |
| 4,561,390 | 12/1985 | Nakamura et al. | 123/90.15 |
| 4,570,581 | 2/1986 | Titolo | 123/90.18 |
| 4,601,266 | 7/1986 | Oldfield et al. | 123/90.18 |
| 4,627,825 | 12/1986 | Bruss et al. | 123/90.15 |
| 4,762,097 | 8/1988 | Baker | 123/90.31 |
| 4,787,345 | 11/1988 | Thoma | 123/90.17 |
| 4,811,698 | 3/1989 | Akasaka et al. | 123/90.17 |
| 5,002,023 | 3/1991 | Butterfield et al. | 123/90.15 |

FOREIGN PATENT DOCUMENTS

| | | | |
|---|---|---|---|
| 2217812 | 11/1989 | United Kingdom | 123/90.17 |

*Primary Examiner*—E. Rollins Cross
*Assistant Examiner*—Weilun Lo
*Attorney, Agent, or Firm*—Jerome R. Drouillard; Roger L. May

[57] ABSTRACT

A modular control mechanism for shifting the phase of a camshaft relative to a crankshaft in an internal combustion engine, accomplished by shifting the angular position of the camshaft relative to the crankshaft. The mechanism comprising two hydraulic cylindrical housings attached to either the camshaft flange or the camshaft driving sprocket, and plungers within the cylindrical housings attached to the other flange to form a rotational hydraulic coupling. The hydraulic cylinders providing a pair of cavities which vary in displacement as the two flanges are rotated relative to one another. A control apparatus regulating the flow of fluid between the hydraulic cylindrical housings, thus controlling the phase shift between the crankshaft and camshaft. The control device using the energy produced by the reaction torque pulses on the camshaft, and resultant pressure pulses in the cavities, thus creating a self-actuating system. The control apparatus consisting of one of three alternate means for precisely controlling the flow of fluid, thus allowing for a modulated self-actuating mechanism.

14 Claims, 4 Drawing Sheets

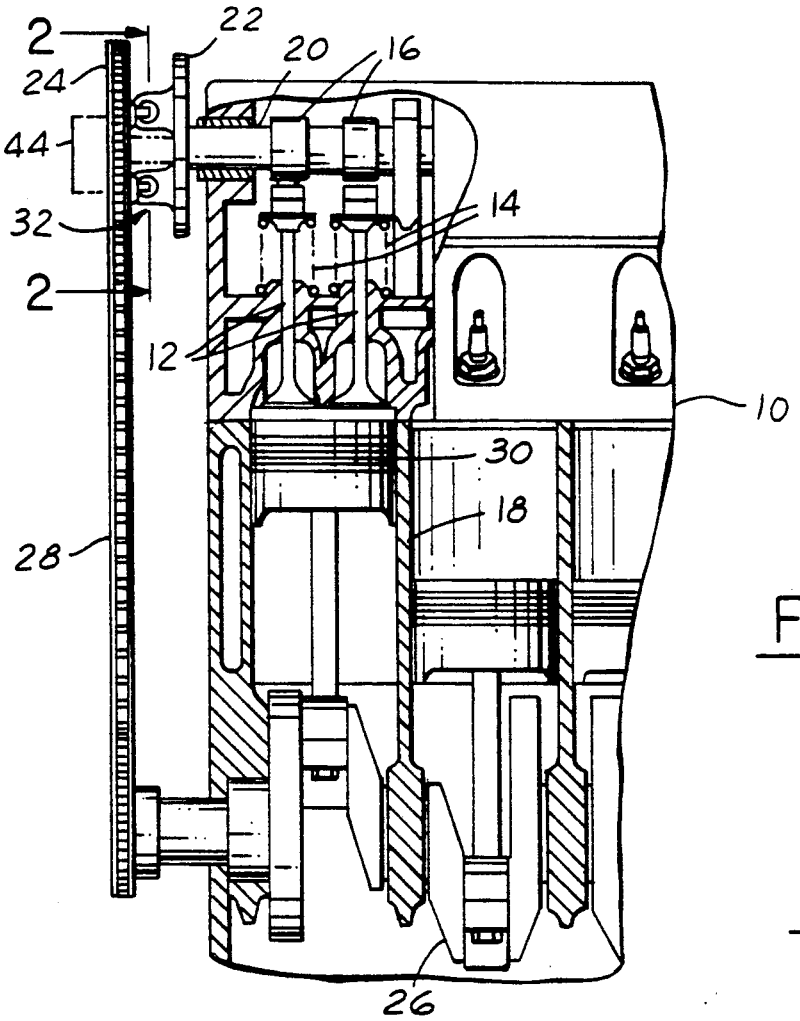
FIG. 1
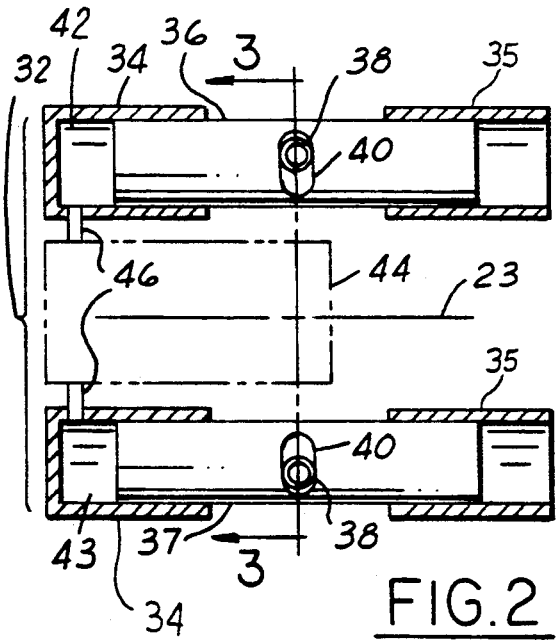
FIG. 2
FIG. 3
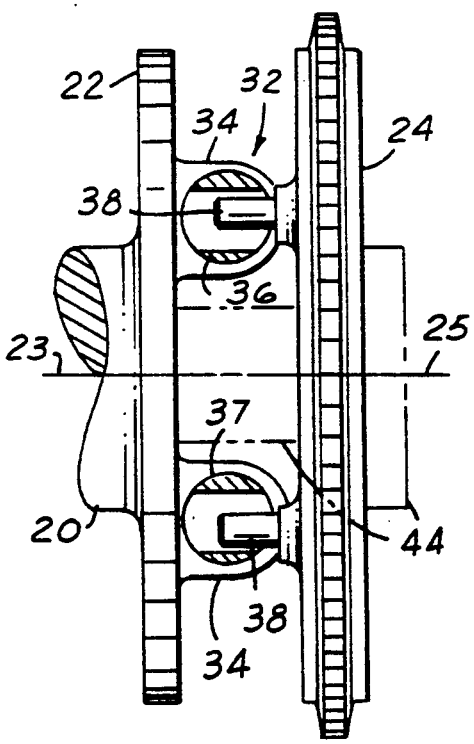

INTERNAL COMBUSTION ENGINE CAMSHAFT PHASE SHIFT CONTROL SYSTEM

TECHNICAL FIELD

This invention relates to phase shifting in an internal combustion engine between the camshaft and crankshaft. More particularly, this invention relates to precise modular control of the timing of engine valves for various engine throttle speeds through the use of a rotational hydraulic coupling between the camshaft driving sprocket and the camshaft.

BACKGROUND ART

Traditionally, the timing between the camshaft and crankshaft are fixed for some predetermined optimum engine speed, but the timing will then be less than optimum at other engine speeds. Varying the timing between the camshaft and crankshaft by accurately modulating the phase shift, to ensure that it is optimized during engine operation, produces several benefits. It is common knowledge that adequate phase shifting will improve idle stability, the broadness of the torque curve and the RPM (revolutions per minutes) range of the engine. Additional benefits to be expected are (i) full control of emission gases and elimination of undesirable emissions [NOx], (ii) part load fuel efficiency improvements and (iii) elimination of external exhaust gas recirculation components and circuitry [EGR].

In developing a device to obtain these benefits, several important considerations are taken into account. The control system of the device should require low power consumption. Further, the response of the system must be fast and accurate to maximize these benefits. Also, a system must be capable of being modulated incrementally throughout an entire range, as opposed to two position phase shifting, i.e., full advance or full retard only, to improve the overall effectiveness of the device.

Prior art, such as U.S. Pat. Nos. 3,685,499 and 3,721,220, have incorporated hydraulic means to accomplish phase shifts between the camshaft and crankshaft to achieve some of these benefits.

In U.S. Pat. No. 3,685,499, to Meacham et al, the phase shifting device is a helical ball spline mechanism. A driven member is fixed to the camshaft and connected by a helical ball spline to a piston which is rotatably fixed relative to the crankshaft. The inner and outer races of the ball spline form an enclosed cavity for hydraulic fluid. This is not a closed system since the flow of fluid into or out of the cavity, to obtain the phase shift, comes from outside the system, i.e. the primary engine oil source, and is continuous throughout the phase shift. Further, it requires the engine oil pressure as the source of energy for effecting the phase shift.

In U.S. Pat. No. 3,721,220 to Garcea, this is shown in a phase shifting device consisting of a drive and driven flange with a pair of hydraulic cylinders which rotate the flanges relative to one another. These cylinders, however, are much different than the present invention. The cylinders are not interconnected and both work in parallel, to accomplish a phase shift, when shifted outward by engine oil pressure.

SUMMARY OF INVENTION

The present invention, on the other hand, does not require the structured complexity of a helical ball spline arrangement.

Additionally, the present invention is in effect a closed system and utilizes pressure induced by the reaction torque pulses in a closed fluid system to accomplish the phase shift.

Further, in the present invention, the hydraulic cylinders work in opposition to one another and are interconnected, thus producing a balanced rotational coupling.

The present invention incorporates these considerations in order to produce a device which will deliver the benefits of optimized engine performance.

The present invention provides for modulated phase shifting, rather than a two position, i.e., full advance/-full retard phase system.

Additionally, the present invention requires low power consumption since the system takes advantage of reaction torque pulses induced by the valve return springs, which are already produced on the camshaft by the engine, as the energy source to retard or advance the camshaft relative to the crankshaft. The phase shifting accomplished by these torque pulses allows for fast response since each cylinder produces one retard and one advance pulse for every 720° of rotation.

The present invention provides a device for modular varying of the timing of the camshaft relative to the crankshaft, thus varying the timing of the engine valve actuation during engine operation. This is accomplished through a lower power consumption technique of self-actuating phase shift wherein the overall engine performance is improved by this phase shifting.

The phase shifting device of the present invention consists of a hydraulic mechanism incorporated between the camshaft driving sprocket and the camshaft itself. The two are rotationally coupled by a pair of hydraulic cylinders, with corresponding plungers, the two providing a pair of cavities which vary in displacement when the camshaft rotates relative to the camshaft driving sprocket. This allows for rotational phase shifting between the camshaft and crankshaft. A control mechanism, positioned between the hydraulic cylinders, along a conduit which interconnects them, regulates the flow of oil between the oil cavities within the two cylinders, thus regulating the phase shift. The control device alternatively prevents any flow of fluid between the two cavities, allows fluid to flow one way causing the camshaft to advance, or allows fluid to flow only the other way causing camshaft retard. The present invention uses the reaction torque pulses, induced by the valve return springs, as the energy for accomplishing the fluid flow between cavities and the resultant phase with low power consumption, since no external hydraulic power is necessary to rotate the coupling.

The three embodiments of the control mechanism forming a part of the present invention incorporate different means of regulating the flow of oil between the rotational hydraulic coupling cavities, and each allows for modular phase shifting with position feedback, or electrical digital feedback, to accurately control the amount of phase shift produced.

Other features and advantages of the present invention will become apparent from the following, more detailed description, taken in conjunction with the accompanying drawings.

BRIEF DESCRIPTION OF DRAWINGS

FIG. 1 is a partial cross sectional view showing a partial view of the side of a reciprocating internal combustion engine, incorporating the present invention;

FIG. 2 is an enlarged cross sectional view taken along line 2—2 of FIG. 1;

FIG. 3 is a cross sectional view taken along line 3—3 of FIG. 2;

BEST MODE FOR CARRYING OUT THE INVENTION

Figure 4:
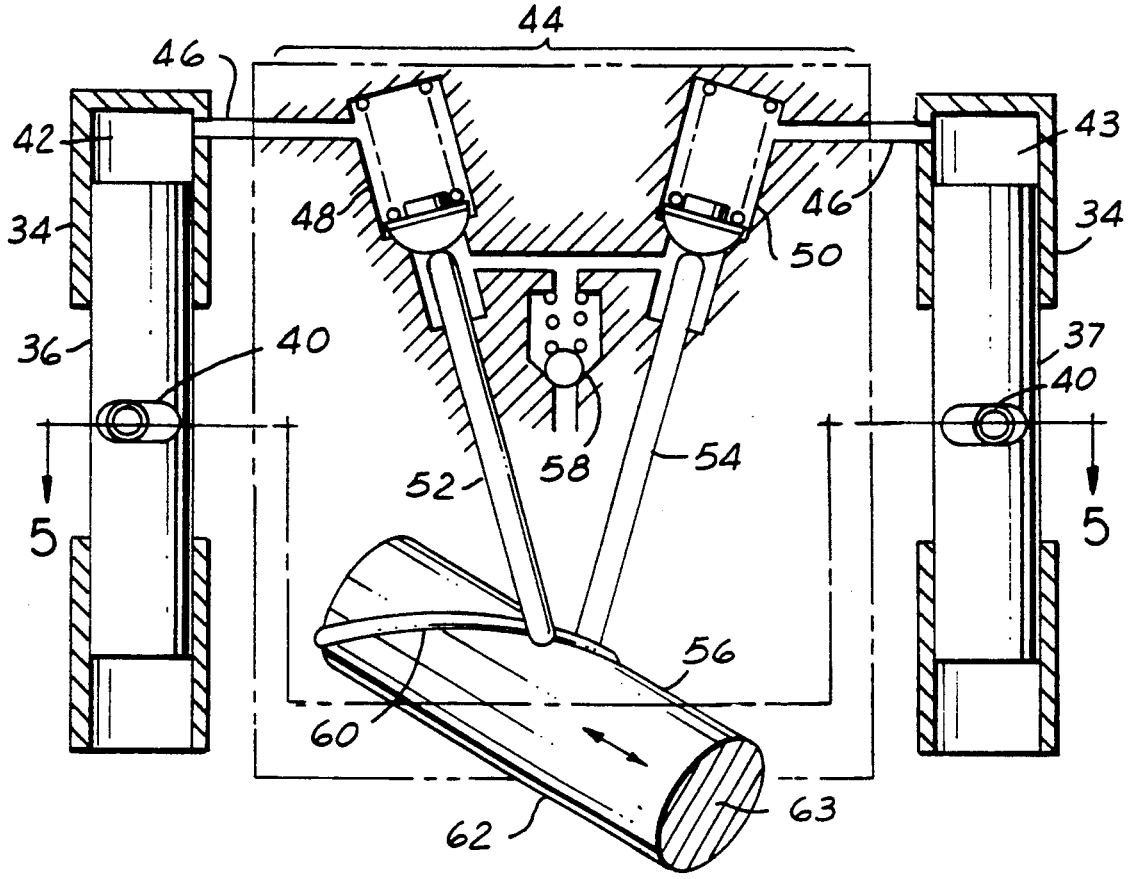
FIG. 4 is a view similar to FIG. 2, and schematically showing one embodiment the phase shift control mechanism of the present invention.

FIG. 1 shows a conventional reciprocating internal combustion engine block 10, with intake and exhaust valves 12 held against cam lobes 16 by the valve springs 14. The cam lobes 16 are integral with a camshaft 20, which in turn is integrally connected to the camshaft flange 22. Flange 22 is rotationally coupled to a camshaft drive sprocket 24 which in turn is coupled to the crankshaft 26 by a timing chain or belt 28. The axis of rotation 23 of the camshaft 20 coincides with the axis of rotation 25 of the camshaft drive sprocket 24. This assembly sets the timing of the engine valve actuation relative to the piston 30 motion or position during engine operation.

The present invention controls the phase shifting of the camshaft 20 relative to the crankshaft 26 during engine operation by means of a hydraulic device 32 which rotationally couples a drive flange, namely, camshaft drive sprocket 24, to a driven flange, namely, the camshaft flange 22.

FIGS. 2-3 illustrate the rotational coupling of the hydraulic device 32. The coupling is positioned between the camshaft flange 22 and the camshaft drive sprocket 24 and includes two cylindrical housings 34. The cylindrical housings 34 are spaced from the central axis 23 and lie in a plane generally perpendicular thereto. Reciprocable pistons or plunger 36,37 reside inside a respective cylindrical housing 34 to cooperate with the cylindrical housings 34 which are rigidly connected to the camshaft flange 22. This arrangement provides a pair of cavities 42 and 43, respectively, at one end of each plunger 36,37. The opposite end of each plunger is supported in an axially aligned open ended cylinder 35. Two pins 38 are rigidly attached to the camshaft drive sprocket 24, and one each is coupled to respective moveable plungers 36,37 by insertion of the pin 38 into plunger slot 40. The interconnected fluid cavities 42,43 are filled with fluid and maintain a constant relative position of the cylindrical housings 34 to the moveable plungers 36,37. Any one of several different hydraulic fluids will work, the most likely being oil. The fluid cavities are interconnected by a conduit 46. Interposed between the two oil cavities 42 and 43, along the conduit 46, is a control device 44.

The reverse of this assembly may also be arranged with cylindrical housings 34 rigidly attached to the camshaft drive sprocket 24 and the pins 38 rigidly attached to the camshaft flange 22.

Operatively, as long as the fluid volume in the interconnected oil cavities 42,43 remains constant within each of them, the camshaft drive sprocket 24 rotationally drives the camshaft flange 22, without any phase change in the timing between the camshaft 20 and the crankshaft 26. Alternatively, as fluid is transferred from one cavity 42 or 43 to the other, the drive sprocket 24 will rotate relative to the camshaft flange 22. The control device 44 regulates the flow of oil between the two oil cavities 42,43. As the control device 44 allows oil to flow from one oil cavity 42 or 43 to the other oil cavity, the plungers 36 slide within the cylindrical housings 34, thus causing the camshaft drive sprocket 24 to rotate relative to the camshaft flange 22, thereby causing a phase shift between the camshaft 20 and the crankshaft 26.

The three embodiments of this invention use different control devices 44 to regulate the flow of oil from one oil cavity 42 or 43 to the other oil cavity, thus causing the phase shift.

Figure 5:
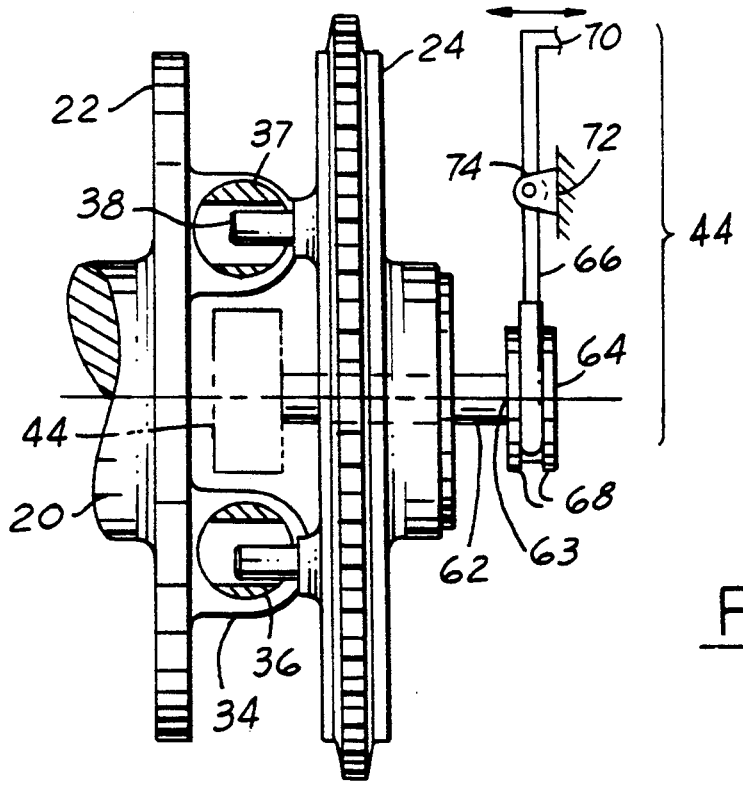
FIG. 5 is a cross sectional view taken along line 5—5 of FIG. 4 rotated 90° counterclockwise.

A first preferred embodiment of a control device for the phase shift system constituting the invention is shown in FIGS. 4 and 5. The oil cavities 42 and 43 are connected by way of conduit 46 to the control device 44, which regulates the flow of oil between the oil cavities 42 and 43. The control device 44 consists of two selectively activatable oppositely directed ball check valves 48 and 50, each engaged by a respective push rod 52,54, interposed between the ball check valves 48 and 50, and a centrally located control spool 56. An oil makeup valve 58 is inserted between the ball valves 48 and 50 to occasionally replenish from a main source any oil which may be lost internally within the system. The ball check valves 48 and 50 and oil makeup valve 58 are rigidly coupled to the camshaft flange 22 and rotate with it along with the cylindrical housings 43.

In operation, when push rods 52 and 54 are not activated, the ball check valves 48 and 50 remain closed and fluid cannot flow between the fluid cavities 42 and 43. Consequently, no phase shift can take place. When one of the push rods 52 or 54 is lifted, fluid flow, in one direction, can take place between fluid cavities 42 and 43, and phase shifts can occur. Lifting one push rod will allow fluid to flow one way causing a camshaft advance, and alternatively lifting the other allows fluid to flow the other way causing camshaft retard. The control device 44 takes advantage of the reaction torque pulses on the camshaft 20, which will produce a corresponding pressure pulse in the fluid cavities 42 and 43, thus no external hydraulic power is necessary to cause fluid to flow and rotate the coupling. Specifically, if push rod 52 was activated and held ball check valve 48 open, a pressure pulse in fluid cavity 42 will push ball check valve 50 open by hydraulic pressure, and fluid will flow from fluid cavity 42 into fluid cavity 43, thereby causing the plungers 36,37 to slide in opposite direction thereby pushing on pins 38 and consequently rotating driven flange 22. This then results in the camshaft 20 advancing relative to the crankshaft 26. If, conversely, a pressure pulse is created in fluid cavity 43 while ball check valve 48 is open, then no fluid would flow since ball check valve 50 would remain closed. Fluid flow in the opposite direction, on the other hand, can be achieved when push rod 54 is activated. The fluid can then flow in the opposite direction in the same manner as described above. This fluid flow, from fluid cavity 43 to fluid cavity 42, would then cause the camshaft 20 to retard relative to the crankshaft 26.

Activation of the push rods is accomplished through a centrally located spool 56. Spool 56 consists of a helical cam lobe 60 formed on an axially adjustable modulating spool 62. The push rods 52 and 54 straddle the helical cam lobe 60. This modulating spool 62 is rotationally fixed relative to the camshaft drive sprocket 24, but is coupled to allow axial adjustment relative to it. A thrust flange member 64 which is at one end 63 of the modulating spool 62 is rigidly connected to the modulating spool 62. A fork 66 rests at one end between the flanges 68 of the thrust flange member 64. The other end of the fork 66 is connected to an input device 70, with some type of external controls, which can move that end of the fork 66 back and forth. The middle of the fork 66 is attached to a hinge 74 which is rigidly fixed relative to the engine block 10.

The fork 66 rotates about hinge 74 to axially move modulating spool 62. When the modulating spool 62 is axially displaced in one direction, one of the push rods 52,54 will ride up on the helical cam lobe 60 and open the corresponding ball check valve 48,50 which will allow a phase shift during the next reaction torque pulse, for example, retarding the timing of actuating the intake and exhaust valves 12. When spool 62 is axially displaced in the opposite direction, the other of the push rods 52,54 will ride up on the cam lobe 60 and open the respective ball check valve 48,50 to allow a phase shift in the opposite direction, for example, to advance the timing.

This embodiment of the control device 44 allows for position feedback control. That is, as a phase shift occurs, there is relative rotation between the control spool 56, which is rotationally fixed relative to the camshaft drive sprocket 24, and the push rods 52,54 which rotate with the camshaft flange 22. This relative rotation as the phase shift occurs will cause the raised push rod 52 or 54 to move off of the helical cam lobe 60 until both push rods 52,54 again straddle the helical cam lobe 60 and the affected ball check valve 48 or 50 is again closed, thus limiting the amount of phase shift.

Figure 6:
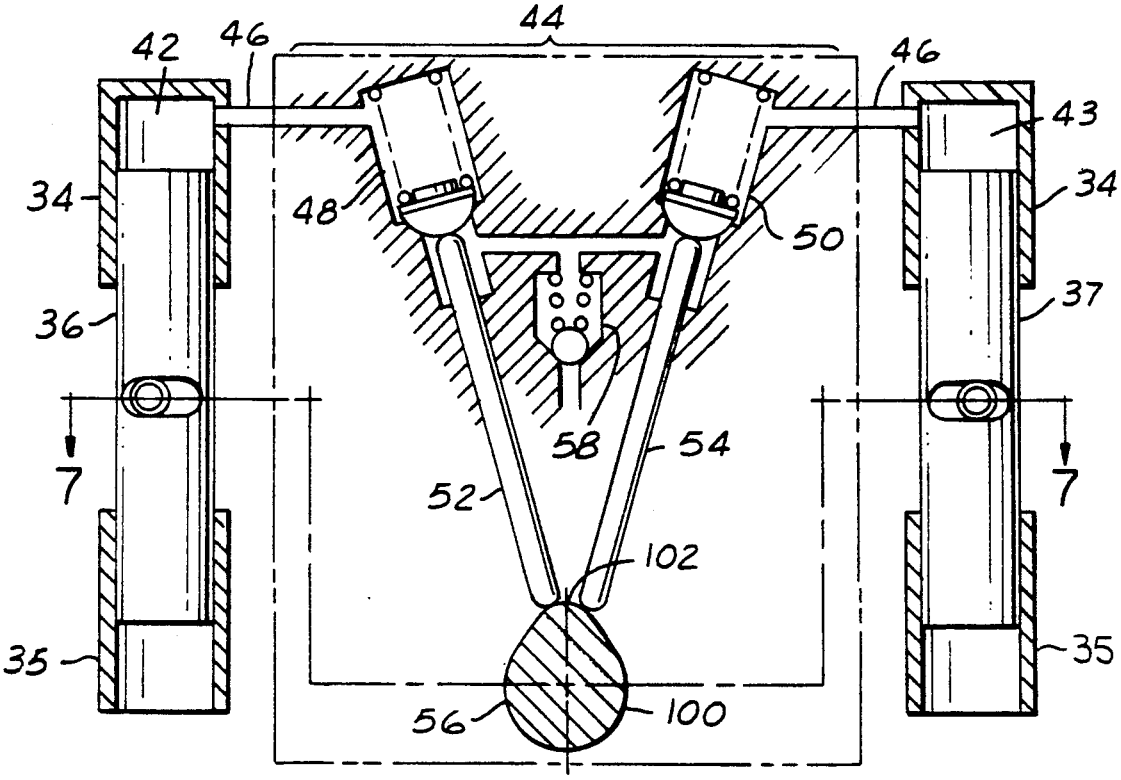
FIG. 6 is a view similar to FIG. 4, showing an alternative embodiment of the phase shift control mechanism of the present invention.
Figure 7:
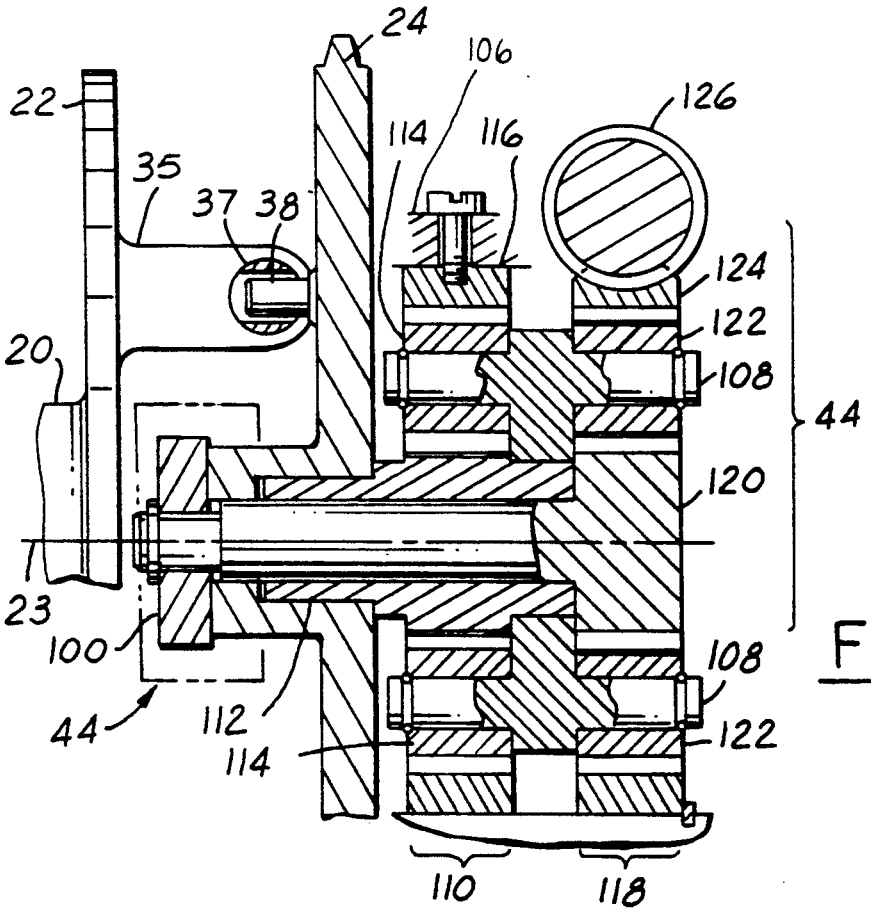
FIG. 7 is a cross sectional view taken along lines 7—7 of FIG. 6 rotated 90° counterclockwise.

In the second preferred embodiment of a control device for this phase shift system, as shown in FIGS. 6 and 7, the ball check valves 48 and 50 and push rods 52 and 54 are identical in structure and function to that described in the first embodiment. The centrally located control spool 56, however, consists of a cam 100 rotationally coupled to the camshaft drive sprocket 24 rather than an axially displacable helical cam lobe 60.

The rotation of the cam 100 relative to the camshaft drive sprocket 24 is accomplished through the use of two sets of substantially coaxial identical planetary gear sets 110,118 rotationally coupled by a common carrier 108, located in the stationary housing 106, as shown in FIG. 7. The planetary gear sets 110,118 have a central axis coincident with the camshaft central axis 23. The first planetary gear set 110 consists of sun gear 112 rigidly attached to the camshaft drive sprocket 24, at least two planet gears 114, and a stationary ring gear 116. The second planetary gear set 118 consists of a sun gear 120 rigidly attached to the control cam 100, at least two planet gears 122, and a ring gear 124. The planet gears 114 and 122 have a common carrier 108 on which the planet gears 114 and 122 are rotatably mounted. The outer surface of ring gear 124 forms a worm gear engaged with a worm 126, which can be driven by an external power source. The worm gear is self locking, so the worm 126 can drive the ring gear 124, but the ring gear 124 cannot drive the worm 126.

The cam 100 normally rotates with the same angular velocity as the camshaft drive sprocket 24, so the push rods 52 and 54 straddle the point of maximum lift, namely the cam lobe 102 shown in FIG. 6. The cam 100 is phase shiftable relative to the camshaft drive sprocket 24 in order to push one of the push rods 52,54 up on to the cam lobe 102 and thereby activate the corresponding ball check valve 48,50 respectively.

In operation, as long as both the ring gears 116 and 124 remain stationery, the sun gear 120, with cam 100, rotates with the same angular velocity as the sun gear 112, with the camshaft drive sprocket 24. Thus, no phase shift will occur. To effect a phase shift the worm gear 126 is rotated by an external power source, causing rotation of the ring gear 124. As a result, the sun gear 120 and fixed cam 100 will be caused to rotate relative to the sun gear 112 and fixed camshaft drive sprocket 24. This in turn results in push rod 52 or 54 activation and phase shift of the camshaft drive sprocket 24 relative to the camshaft 22, in the manner previously described, until the push rods 52 or 54 again straddle the cam lobe 102.

The second preferred embodiment, similar to the first preferred embodiment, also uses position feedback control. When one of the ball check valves 48 or 50 is activated, a pressure pulse, as caused by the reaction torque pulses induced by the valve return springs, in the proper fluid cavity 42 or 43 will cause the fluid to flow from that chamber to the other. The resulting phase shift between the camshaft flange 22, which the check valves 48 and 50 are rigidly attached to, and the camshaft drive sprocket 24, which the cam 100 is rotationally coupled to, results in a rotation of the push rods 52 and 54 relative to the cam 100 until the push rods 52 and 54 again straddle the cam lobe 102, thereby deactivating the ball check valves 48 and 50 and terminating the phase shift.

Figure 8:
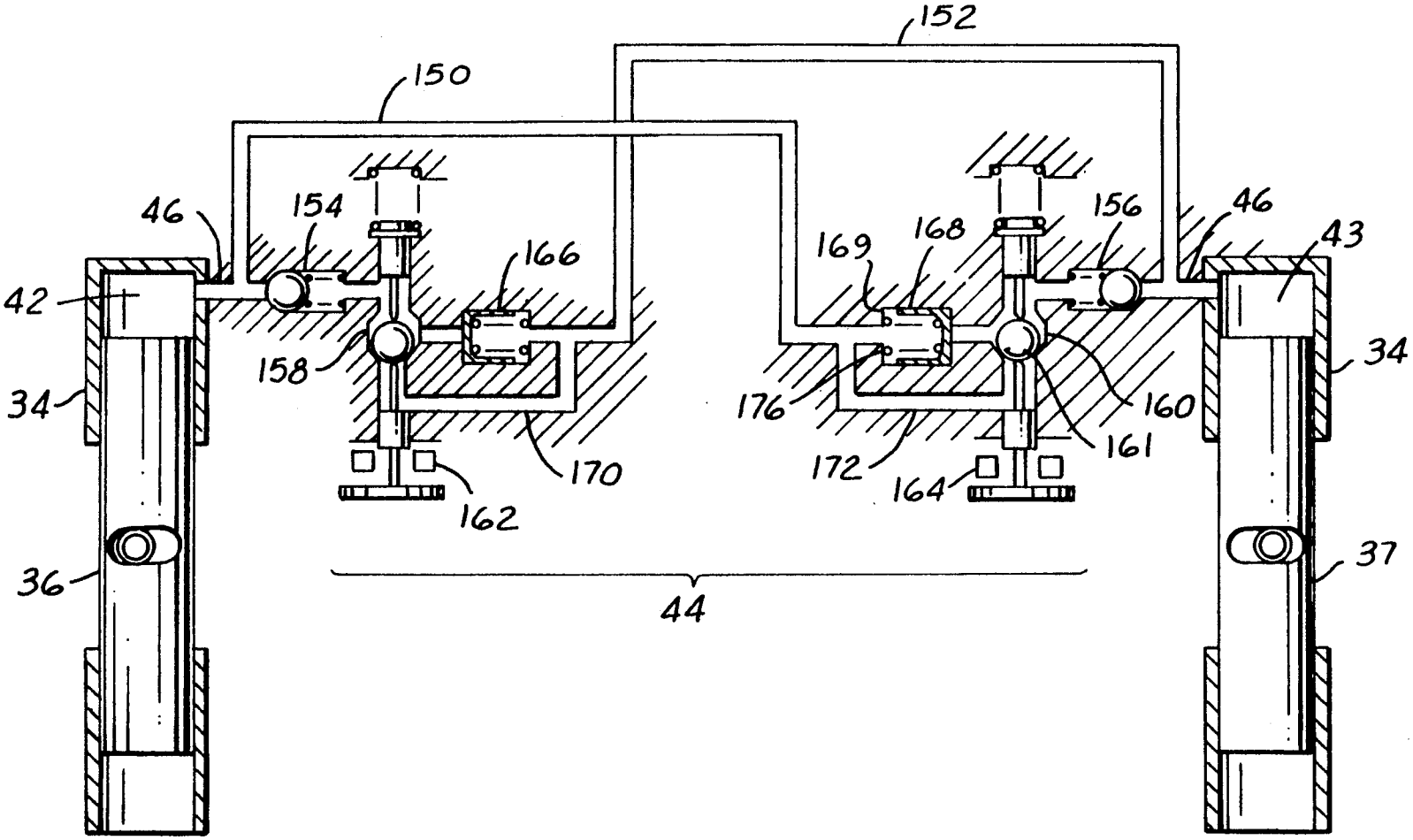
FIG. 8 is a view similar to FIG. 4, showing yet another embodiment of the phase shift control mechanism of the present invention.

FIG. 8 shows a third preferred embodiment of a control device 44 for the subject invention. It provides or allows compact, digitally controllable phasing. It includes two separate hydraulic flow paths as represented by conduits 150 and 152 for transferring fluid between fluid cavity 42 and fluid cavity 43, one for retarding the timing and one for advancing the timing between the camshaft 20 and the crankshaft 26. Interposed along the conduit 150 sequentially beginning at fluid cavity 42 is a shuttle plunger 168, three way ball type control valve 160, and check valve 156. The shuttle plunger 168 and check valve 156 are each spring biased normally closed. The three-way control valve 160 is activated by solenoid 164. The remaining flow path through conduit 152 is constructed identically to that of conduit 150 and includes shuttle plunger 166, check valve 154 and three-way control valve 158 controlled by solenoid 162. Bypass passages 170 and 172 connect to the fluid conduits 152 and 150 respectively, on either side of the shuttle plungers 166 and 168, providing an alternate route for fluid to flow around the shuttle plungers 166 and 168.

In operation, when a reaction torque pulse induced by the valve return spring 14 forces the moveable plunger 37 in the retard direction, the moveable plunger 37 will force fluid out of cavity 43, through check valve 156, towards the shuttle plunger 168. Shuttle plunger 168 will move to its stop 169 and thereby allow fluid to fill the chamber formed at the head of the plunger 168. The plunger will remain in this fully depressed position abutting stop 169 since ball check valve 156 will close between torque pulses and the fluid chamber between shuttle plunger 168 and check valve 156 will be filled and ball valve 161 will be seated against the valve seat leading to bypass passage 172. Upon actuation of solenoid 164 the ball valve 161 will be lifted off its seat. This then allows the fixed volume of fluid from shuttle plunger 168 to be forced by return spring 176 acting on the shuttle plunger 168 through bypass passage 172. Consequently, fluid is transmitted through conduit 150 to fluid cavity 42, thus retarding the timing by a small predetermined amount per every torque pulse. The amount of phase shift is limited by the displacement volume of the shuttle plunger 168. Each time the solenoid 164 activates the three-way control valve 160, shuttle plunger 168 will move to its base position, due to the bias of shuttle plunger return spring 176, and force the fixed volume of fluid to chamber 42. Now when the next reaction torque pulse and a corresponding pressure pulse occurs in fluid cavity 43, the shuttle plunger can move again and send fluid into fluid cavity 42, thus causing another incrementally predetermined phase shift.

Alternatively, conduit 152, with an identical set of components, allows a phase shift in the opposite direction. Each time solenoid 162 is energized, this will return the shuttle plunger 166 to its base position until the next torque pulse, which will allow for fluid to transfer from fluid cavity 42 to fluid cavity 43, thus resulting in an incrementally predetermined phase shift between the camshaft 20 and the crankshaft 26.

While the best modes for carrying out the invention have been described in detail, those familiar with the art to which this invention relates will recognize alternative designs and embodiments for practicing the invention. Thus, the above described preferred embodiment is intended to be illustrative of the invention which may be modified within the scope of the following appended claims.

We claim;

1. In an internal combustion engine, a rotary coupling for varying the timing of at least one camshaft relative to a crankshaft, said rotary coupling comprising:

a drive flange adapted to be coupled to the crankshaft for rotation about an axis;

a driven flange adapted to be coupled to said at least one camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

control means for selectively actuating said valve means to cause said drive flange and said driven flange to rotate in either direction relative to one another whereby the timing may be selectively advanced or retarded;

said control means comprising first and second oppositely directed digital selectively actuable shuttle plunger members within said conduit means interconnecting said pair of fluid chambers;

said first and second shuttle plungers being hydraulically coupled to said first and second fluid chambers, respectively;

each said shuttle plunger member storing a predetermined volume of fluid under pressure to be selectively transferred to a respective one of said fluid chambers in response to a control signal;

and control valve means within said conduit means for blocking the flow of fluid from said shuttle plunger member when no phase shift is to be effected and for selectively allowing the flow of fluid from either said shuttle plunger when an incremental phase shift is to be effected, thereby allowing a specified volume of fluid to be transferred between said fluid chambers in a first direction in response to a digital advance signal and allowing a specified volume of fluid to be transferred between said fluid chambers in a second direction in response to a digital retard signal, thereby limiting the amount of piston motion during any pressure cycle.

2. The rotary coupling of claim 1 wherein said control valve means includes a first and second solenoid actuated valve operatively associated with said first and second shuttle plunger members, respectively, and each of said first and second shuttle plunger members being normally in open fluid communication with the other of fluid chambers when said solenoid actuated valve is closed whereby each of said shuttle plunger members are continuously charged with said predetermined volume of fluid.

3. In an internal combustion engine having a crankshaft and at least one camshaft, wherein the camshaft is subject to torque reversals associated with opening and closing of the engine valves during engine operation, a phase shifting mechanism comprising:

a first member rotatably coupled to and driven by the crankshaft for adjusting the phasing of the camshaft relative to the crankshaft;

a second member affixed to the camshaft, said second member comprising hydraulic means;

piston means in said hydraulic cylinder means and thereby forming first and second hydraulic chambers adapted to be filled with a fluid, said piston means being connected to the first member;

a hydraulic passage between said hydraulic chambers, said hydraulic passage incorporating normally closed first and second hydraulic check valves;

said check valves being oppositely directed relative to one another whereby (i) when the first check valve is open, fluid can flow in one direction only from the first chamber to the second chamber and will be precluded from flowing in the opposite second direction, and (ii) when the second check valve is open, fluid can flow in the second direction only from the second chamber to the first one and will be precluded from flowing in the opposite first direction, and (iii) when both check valves are closed, no flow between the first and second hydraulic chambers is possible and the rotation of the first member is transmitted through said piston and fluid trapped in the two hydraulic chambers to the second member so that both members rotate with the same angular velocity;

a control cam operatively coupled to each of said two check valves to act thereupon and selectively open either one of said check valves while maintaining the other check valve closed, said control cam normally rotating with the same angular velocity as the first and second members and occupying a relative position in which both said first and second check valves are closed;

said control cam being phase shiftable relative to the first member and thereby resulting in a temporary phase shift relative to the second member, the temporary phase shift resulting in the opening of a preselected one of said check valves, depending on the preselected direction of the phase shift, and thereby allowing fluid flow from one said chamber to the other and causing the second member to phase shift relative to the first member and relative to the control cam in the same direction as the control cam was phase shifted, said phase shift of the second member continuing until the original relative position at the second member and the control cam is restored; and rotary coupling means normally rotating the control cam with the same angular velocity as the first member for phase shifting the control cam relative to the first member.

4. The invention of claim 3 wherein said control cam comprises a reciprocal control spool coaxially aligned with said first and second members;

said control spool including a helical cam lobe on its surface, said control spool being rotatably fixed relative to said first member and axially shiftable relative to said first member;

each check valve including a push rod for opening the check valve to allow fluid flow therethrough;

said push rods straddling said helical cam lobe; and actuating means for axially shifting said spool in both directions thereby causing one of said push rods to open one of said check valves when said spool is shifted in either direction, whereby both said check valves will be caused to open to allow fluid to transfer in one direction only from one of said fluid chambers to the other until aid drive flange sand said driven flange rotate sufficiently to cause both said push rods to again straddle said helical cam lobe, thereby closing off said check valves and terminating said phase shaft.

5. The invention of claim 3 wherein said control cam comprises a cam rotatably coupled to said first member and having a cam lobe of maximum lift;

each check valve including a push rod for opening the check valve to allow fluid flow therethrough;

said push rods straddling said cam lobe;

actuating means for radially shifting said cam in both directions thereby causing one of said push rods to open one of said check valves when said spool is shifted in either direction, whereby both said check valves will be caused to open to allow fluid to transfer in one direction only from one of said fluid chambers to the other until said drive flange and said driven flange rotate sufficiently to cause both said push rods to again straddle said cam lobe, thereby closing off said check valves and terminating said phase shaft.

6. In an internal combustion engine, a rotary coupling for varying the timing of at least one camshaft relative to a crankshaft, said rotary coupling comprising:

a drive flange adapted to be coupled to the crankshaft for rotation about an axis;

a driven flange adapted to be coupled to said at least one camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

said housing means comprising a pair of substantially identically sized cylindrical housings diametrically opposed from one another and substantially equally radially spaced from said axis whereby said housing means is dynamically balanced relative to said one flange;

said piston means comprising a pair of substantially identically sized pistons, one each being received within a respective one of said cylindrical housings;

each of said pistons defining with a respective one of said cylindrical housings a respective one of said fluid chambers;

said fluid chambers being diametrically opposed relative to one another whereby said hydraulic coupling is dynamically balanced;

said piston means being interconnected to said driven flange;

said driven flange including a pair of diametrically opposed pins equally radially spaced from said axis and extending parallel to said axis; and each said pin being received within a respective piston;

whereby as each said piston is caused to translate relative to said housing, said pins will be engaged to drive said driven flange.

7. The rotary coupling of claim 6 further including, control means for selectively actuating said valve means to cause said drive flange and said driven flange to rotate in either direction relative to one another whereby the timing may be selectively advanced or retarded.

8. In an internal combustion engine, a rotary coupling for varying the timing of at least one camshaft relative to a crankshaft, said rotary coupling comprising:

a drive flange adapted to be coupled to the crankshaft for rotation about an axis;

a driven flange adapted to be coupled to said at least one camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

said housing means comprising a pair of substantially identically sized cylindrical housing diametrically opposed from one another and substantially equally radially spaced from said axis whereby said housing means is dynamically balanced relative to said one flange;

said piston means comprising a pair of substantially identically sized pistons, one each being received within a respective one of said cylindrical housings;

each of said pistons defining with a respective one of said cylindrical housings a respective one of said fluid chambers;

said fluid chambers being diametrically opposed relative to one another whereby said hydraulic coupling is dynamically balanced;

said valve means comprising first and second normally closed valves within said conduit means and precluding the transfer of fluid from one said fluid chamber to the other;

control means for selectively actuating to an open position each of said valves, whereby actuating one said valve allows fluid to transfer in one direction between said fluid chambers expanding one said chamber and contracting the other thereby causing said driven flange to be rotated in one direction to advance the camshaft relative to the crankshaft, and whereby actuating the other said valve allows fluid to transfer in an opposite direction between said fluid chambers contracting said one chamber and expanding said other chamber thereby causing said driven flange to be rotated in the other direction to retard the camshaft relative to the crankshaft; and said valve means including a pair of reciprocable push rods, each push rod being disposed in coaxial alignment with a respective one of said valves at the inlet end of each said valve, one end of each said push rod engaging a respective one of said first and second valves, the other end of each said push rod being in engagement with said control means.

9. The rotary coupling of claim 8 wherein said control means comprises a reciprocable control spool coaxially aligned with said axis;

said control spool including a helical cam lobe on its surface, said control spool being rotatably fixed relative to said drive flange and axially shiftable relative to said drive flange;

said push rods straddling said helical cam lobe; and actuating means for axially shifting said spool in both directions thereby causing one of said push rods to open one of said check valves when said spool is shifted in either direction, whereby both said check valves will be caused to open to allow fluid to transfer in one direction only from one of said fluid chambers to the other until said drive flange and said driven flange rotate sufficiently to cause both said push rods to again straddle said helical cam lobe, thereby closing off said check valves and terminating said phase shaft.

10. The rotary coupling of claim 9 wherein said spool further includes a thrust member, an actuation fork member adapted to be rotatably mounted externally of said rotary coupling and operatively connected to said thrust member, said fork member being actuated in response to a control signal whereby the fork member will advance or contract said spool to effect a phase shift.

11. The rotary coupling of claim 8 wherein said control means comprises a cam rotatably coupled to said drive flange and having a cam lobe of maximum lift, said push rods straddling said cam lobe, actuating means for radially shifting said cam in both directions thereby causing one of said push rods to open one of said check valves when said spool is shifted in either direction, whereby both said check valves will be caused to open to allow fluid to transfer in one direction only from one of said fluid chambers to the other until said drive flange and said driven flange rotate sufficiently to cause both said push rods to again straddle said helical cam lobe, thereby closing off said check valves and terminating said phase shaft.

12. The rotary coupling of claim 11 wherein said actuating means comprises a planetary gear set means having an output member coaxially aligned and rotatably coupled with said drive flange, said cam being operatively coupled to said output member and a rotatable input member adapted to be intermittently rotated in response to a control signal to effect a phase shift between said drive and driven flanges.

13. The rotary coupling of claim 12 wherein said planetary gear set means comprises first and second planetary gear sets coaxially aligned along a common axis, each set having three elements, a sun gear, a ring gear and a planet carrier;

one of said elements in the first set providing an input for cooperating with the crankshaft and a corresponding element in the second set providing an output cooperating with the camshaft and constituting said output member, another one of said elements in the first set being affixed to the corresponding element in the second set for rotation therewith; and a third element in one set being affixed to the engine and a corresponding element in the other set constituting said output member and being adjustably fixed to the engine for a limited rotation about the axis to cause the timing of the camshaft and the crankshaft to vary.

14. The rotary coupling of claim 12 wherein said planetary gear set means comprises first and second substantially identical sets of coaxial planetary gear sets, each said planetary gear set including a sun gear, a ring gear, and at least two planet gears having a common planet gear carrier;

said sun gear of said first gear set being affixed to said drive flange and said sun gear of said second gear set being affixed to said cam;

said ring gear of said first gear set being rigidly fixed relative to the engine, said ring gear of said second gear set being adapted to be rotatably mounted to a worm gear fixed relative to the engine block and rotatable by an external device responding to an input signal whereby rotation of the worm gear will cause rotation of the first gear set relative to the second gear set resulting in relative rotation of said cam to said drive flange.

* * * * *